US005096020A

United States Patent [19]

Korhonen

[11] Patent Number: 5,096,020

[45] Date of Patent: Mar. 17, 1992

[54] ELEVATOR SAFETY APPARATUS

[75] Inventor: Helge Korhonen, Oitti, Finland

[73] Assignee: Kone Elevator GmbH, Baar, Switzerland

[21] Appl. No.: 627,572

[22] Filed: Dec. 14, 1990

[30] Foreign Application Priority Data

Dec. 14, 1989 [FI] Finland ..... 895998
Nov. 15, 1990 [FI] Finland ..... 905670

[51] Int. Cl.[5] ..... B66B 5/22

[52] U.S. Cl. ..... 187/88; 187/80; 187/86; 188/43

[58] Field of Search ..... 187/80, 81, 82, 83, 187/84, 85, 86, 87, 88, ; 188/43, 44, 67, 72.2, 73.45, 166

[56] References Cited

U.S. PATENT DOCUMENTS 171,526 12/1875 Milchsack ..... 187/88
943,523 12/1909 Cunningham ..... 187/88
4,819,765 4/1989 Winkler et al. ..... 187/88

FOREIGN PATENT DOCUMENTS 728326 7/1932 France .
1361097 12/1987 U.S.S.R. .

*Primary Examiner*—Joseph E. Valenza
*Assistant Examiner*—Dean A. Reichard

[57] ABSTRACT

An elevator safety apparatus is disclosed which is designed to be mounted on an elevator car, which car moves along guide rails; said apparatus comprising a frame, an area for wedge housings formed in the frame, and wedges placed in the wedge housings on each side of a guide rail; the wedges gripping the guide rail when the safety apparatus is activated, the wedges being placed relative to each other such that the wider end of one wedge points upwards while the wider end of the second wedge points downwards. To allow safety apparatus action in both an upward and downward direction, the apparatus is provided with an activating mechanism connected to and moving both wedges, and an overspeed governor, or the equivalent, for controlling the activating mechanism.

9 Claims, 3 Drawing Sheets

ELEVATOR SAFETY APPARATUS

BACKGROUND OF THE INVENTION

1. Field of the Invention

This invention relates to a safety apparatus designed to be mounted on an elevator car, which car moves along guide rails; said safety apparatus comprising a frame, an area for wedge housings formed in the frame, and wedges placed in the wedge housings on each side of a guide rail; said wedges gripping the guide rail when the safety apparatus is activated, the wedges being placed relative to each other such that the wider end of one wedge points upwards while the wider end of the second wedge points downwards.

2. Description of Related Art

In certain countries, the regulations concerning elevators have been revised to help prevent accidents where, (i) an elevator car crashes against the ceiling of the hoistway after an overspeed upward drive; and, (ii) a passenger is injured by the doorway structures of an elevator car which has moved off from a floor with the doors open.

The new regulations also provide more freedom of design of the safety equipment, as they now accept even non-mechanical solutions.

The device of invention is designed to stop the motion of an elevator car unit, when necessary. To stop an elevator car unit, both the elevator car unit and the counterweight can be provided with safety gears as defined, for example, in FI publication print 74686. It is also possible to provide an overspeed governor with an electrically operated low speed trigger to guarantee safety in the doorway area. However, this is an expensive solution. Moreover, the low speed trigger occupies a large space in the hoistway since the counterweight, too, must be provided with similar safety gear.

An alternative possibility is to use known safety apparatuses together with rope arresters mounted in the machine room. However, this solution is expensive and difficult to implement in differen rope systems.

SUMMARY OF THE INVENTION

It is an object of the present invention to eliminate the inherent disadvantages of prior elevator safety apparatuses, and to provide an improved apparatus wherein each wedge is provided with an activating means for moving said wedge in its housing, thereby allowing gripping motion in both an upward and downward direction.

Accordingly, the invention provides a safety apparatus designed to be mounted on an elevator car, which car moves along guide rails; said safety apparatus comprising a frame, an area for wedge housings formed in the frame, and wedges placed in the wedge housings on each side of a guide rail; said wedges gripping the guide rail when the safety apparatus is activated, the wedges being placed relative to each other such that the wider end of one wedge points upwards while the wider end of the second wedge points downwards; and wherein the safety apparatus is also provided with an activating means connected to each wedge and serving to move each wedge within its housing to allow gripping action in both an upward and downward direction.

The safety apparatus of invention satisfies the new safety requirements using a single standard device. The inventive apparatus is cheaper than prior safety devices because it contains fewer components and because the two halves of the safety apparatus comprise identical parts.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
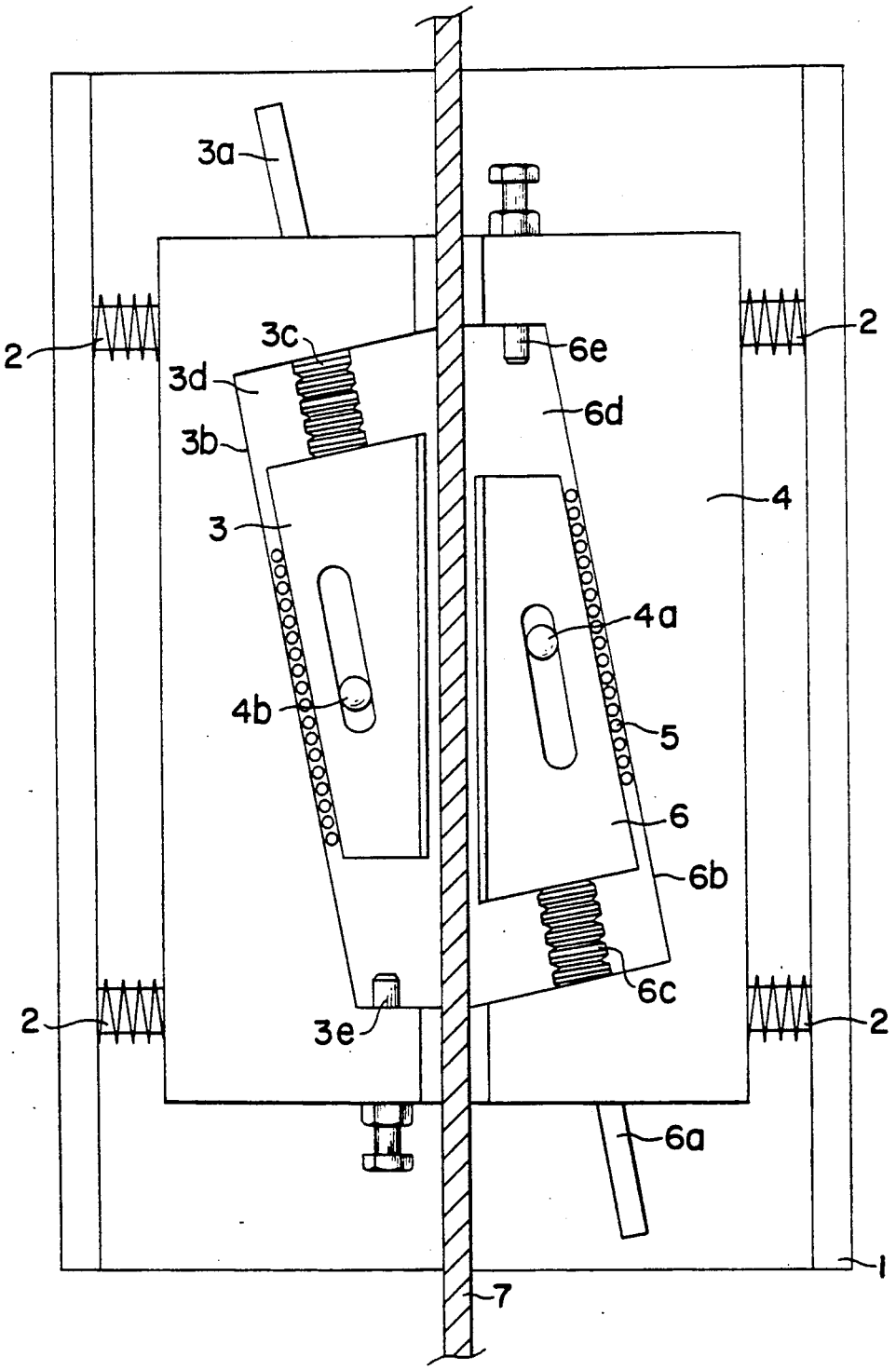
FIG. 1 depicts a preferred embodiment of the safety apparatus of the instant invention as viewed from the plane of the guide rail.

Referring now to the drawings, the preferred form of the safety apparatus of the instant invention comprises a frame 4 which is attached to the elevator car unit 1 by means of spring-loaded bolts 2 in such a manner that the frame 4 can move laterally against the spring force along the bolts 2. The frame is provided with housings 3*d* and 6*d* which house wedges 3 and 6 on each side of guide rail 7. The wedges move against guide surfaces 3*b* and 6*b* provided in the frame 4, said surfaces being at an oblique angle relative to the guide rail. The upper edge of guide surface 3*b* is further away from guide rail 7 than its lower edge and, correspondingly, the lower edge of guide surface 6*b* is further away from guide rail 7 than its upper edge. Wedge 3 moves along guide surface 3*b* and wedge 6 moves along guide surface 6*b*. To reduce friction, bearing means 5 is provided between the wedges and the guide surface. The wedges are provided with pilots 4*a* and 4*b*, respectively.

In the embodiment depicted in FIG. 1, the safety apparatus comprises actuating rods 3*a* and 6*a* attached to the upper end of wedge 3 and to the lower end of wedge 6, respectively. A pressure spring 3*c* is provided around the actuating rod between the upper end of wedge 3 and the upper end of the wedge housing 3*d*. Similarly, a pressure spring 6*c* is provided between the lower end of wedge 6 and the lower end of the wedge housing 6*d*. The lower end of the wedge housing 3*d* is provided with an adjusting screw 3*e* and the upper end of wedge housing 6*d* is provided with adjusting screw 6*e*. Thus, the wedges act in opposite directions.

The safety apparatus of invention operates as follows:

When the elevator car unit moves downwards at too high a speed or when the car has positioned itself too low with the doors open, actuating rod 6*a* is pushed upwards. Wedge 6 slides against guide rail 7, the entire apparatus moves right along the guide bolts 2 and wedge 3 touches guide rail 7. Wedge 3 then rises, thereby increasingly compressing spring 3*c*, until wedge 6 touches adjusting screw 6*e*. In this situation, a substantially constant pressure prevails across spring 3*c*. In reality, however, some vibration occurs due to variations in the friction, but the pressure remains essentially constant. When wedge 6 touches the adjusting screw, the braking force is at a maximum and, due to the constant pressure of spring 3*c*, acts in a constant direction until the elevator car comes to a stop. Wedge 3 then rises compressing spring 3c until wedge touches the adjusting screw 6e.

The small angle of the spring 3c relative to guide rail 7 allows substantially normal forces to be generated relative to the guide rail. The term "normal force" means a pressure acting in a direction perpendicular to the guide rail. This angle allows sufficient gripping forces to be achieved together with low spring pressure, and therefore only requiring a small spring.

For upward movement, the safety apparatus acts in a corresponding manner. When actuating rod 3a is pushed downwards, wedge 3 moves against guide rail 7 and the entire apparatus moves left and wedge 6 touches the guide rail. Wedge 6 then moves downwards compressing spring 6c until wedge 3 touches adjusting screw 3e.

Since braking is initiated during downward travel by wedge 6 and during upward travel by wedge 3, it is possible to set different braking forces for the safety apparatus gripping action of upward and downward elevator car travel.

The necessary information regarding the need for safety apparatus action can be obtained, for example, from a separate tachometer monitoring the car movement. The wedges can be moved, for instance, by using electromagnets.

Figure 2A:
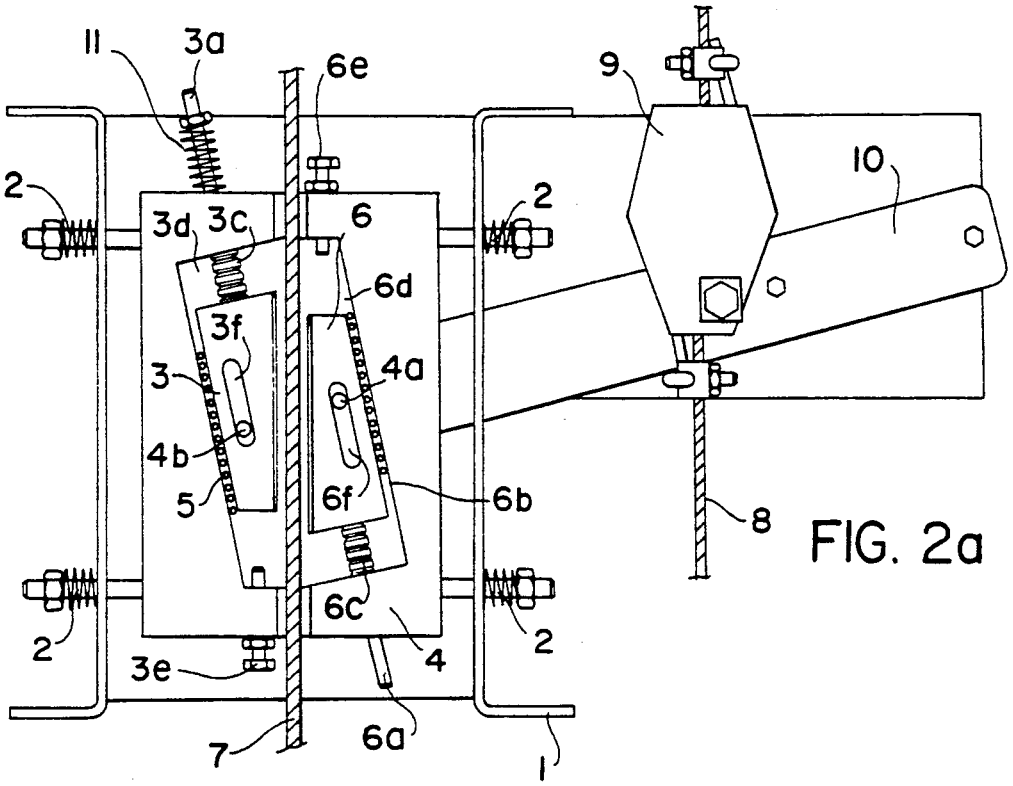
FIGS. 2*a* and 2*b* each illustrate an alternative embodiment of the safety apparatus of the instant invention as viewed from about and from one side in the plane of the guide rail.
Figure 2B:
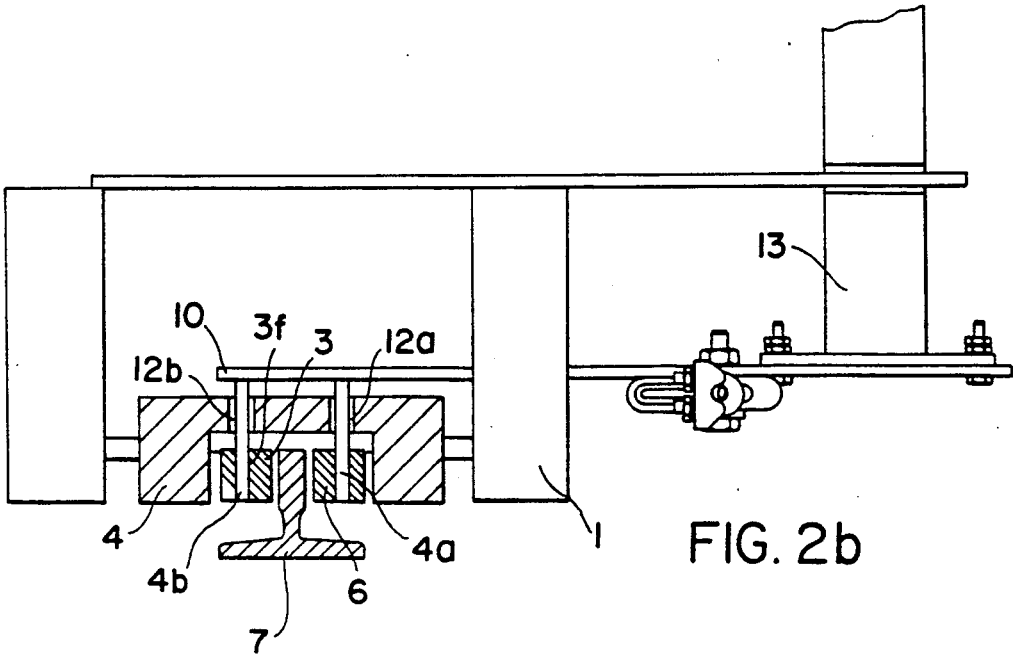

In the embodiment illustrated by FIGS. 2a and 2b, saftey apparatus action in both the downward and upward directions is initiated by an overspeed governor which triggers the apparatus when its speed of rotation exceeds an allowed limit, regardless of direction. When elevator movement in the upward direction is accelerated and reaches the preset gripping speed, the overspeed governor is locked and the activating lever 10 connected to it via the attachment 9 of rope 8 is turned in an anti-clockwise direction. Pin 4b of the activating lever hits the lower edge of the elongated slot 3f laid in the direction of movement of wedge 3, and wedge 3 then moves downward along guide surface 3b, compressing spring 11. Pin 4a moves freely in the slot 6f of wedge 6 and both pins 4a and 4b move freely in the slots 12a and 12b of the safety apparatus housing. Wedge 3 slides against the guide rail, the safety apparatus housing 4 moves left and wedge 6, too, touches the guide rail. Wedge 6 moves downwards compressing spring 6c until wedge 3 touches the adjusting screw 3e. During downward travel, the activating lever 10, connected to a synchronizing tube 13, turns in a clockwise direction and the safety apparatus operates in a corresponding manner.

Figure 3A:
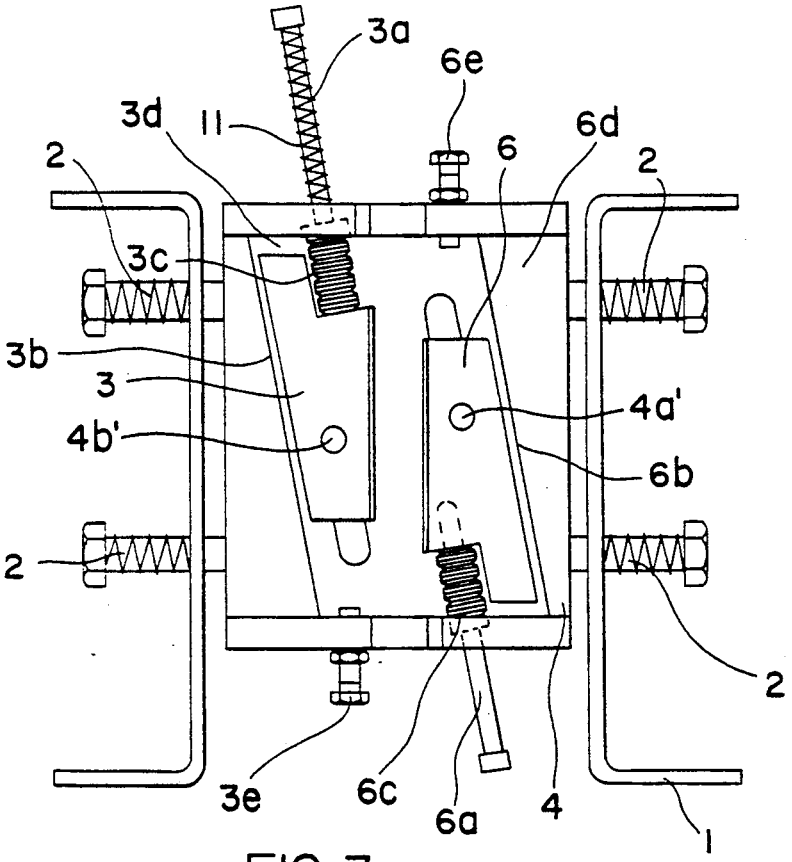
FIGS. 3*a* to 3*c* each depict an additional embodiment of the safety apparatus of the instant invention.
Figure 3B:
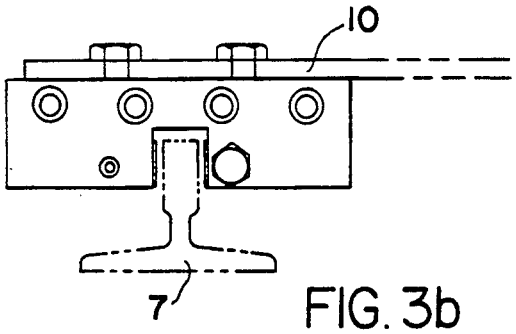
Figure 3C:
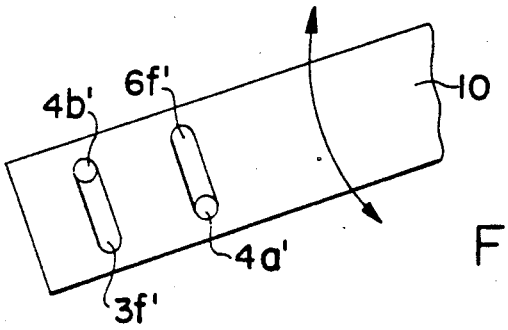

The solution illustrated by FIGS. 3a to 3c is fully analogous to that depicted in FIGS. 2a and 2b, with the difference that slots 3f' and 6f' are placed in the activating lever 10 in a transverse directin relative to the lever. In this case, the wedges are provided with pins 4a' and 4b'.

It will be obvious to a person skilled in the art that different embodiments of the invention are not restricted to the examples described above, but may instead be varied within the scope of the following claims.

I claim:

1. A safety apparatus adapted for mounting on an elevator car purposed for movement along guide rails, comprising:

a spring-mounted frame for vertically slidable engagement with and bi-directional lateral movement in relation to the guide rail;

at least two wedge housings disposed within said frame, said wedge housings being disposed on opposed faces of a guide rail opening formed within said frame and at least one wedge being disposed in each of said wedge housings;

wherein said wedges are disposed in inverted opposed relationship to each other; and each of said wedges having an activating means connected thereto for vertically displacing said wedge, whereby said frame is predeterminately laterally displaced thereby bringing an opposed wedge into contact with the guide rail causing the guide rail to be gripped interjacent said wedges.

2. The safety apparatus as claimed in claim 1, further comprising a pressure spring provided between the wider end of each of said wedges and said wedge housing associated therewith.

3. A safety apparatus as claimed in claim 1, wherein said activating means connected to one of said wedges is actuated by a different level of applied force than that of the opposed wedge.

4. The safety apparatus as claimed in claim 1, wherein each said activating means is an actuating rod connected to the wider end of each said wedge.

5. The safety apparatus as claimed in claim 1, 2 or 4, wherein each said activating means is moved by means of an electromagnet.

6. The safety apparatus as claimed in claim 1, or 2, wherein each of said wedges is provided with a slot laid substantially in the direction of wedge motion and accommodating a projection attached to an activating lever, which moves said wedges and is actuated by an overspeed governor.

7. The safety apparatus as claimed in claim 1, or 2, wherein each of said wedges is provided with a projection, each said projection being accommodated in a substantially transverse slot, each said slot being provided in an activating lever which moves said wedges and is actuated by an overspeed governor.

8. The safety apparatus as claimed in claim 1, 2 or 4, wherein each said wedge housing is provided with an adjusting screw permitting adjustment of the stopping position of said wedge associated therewith during safety apparatus action.

9. The safety apparatus as claimed in claim 1, 2 or 4, wherein the safety apparatus has a symmetrical construction relative to the guide rail with at least one wedge housing being upside down relative to another said wedge housing.

* * * * *